US005887782A

United States Patent [19]

Mueller

[11] Patent Number: 5,887,782

[45] Date of Patent: Mar. 30, 1999

[54] HIGH STACKING STRENGTH AUTOMATIC CORRUGATED BOX

[76] Inventor: Charles J. Mueller, 140 W. Kohler, Sun Prairie, Wis. 53590

[21] Appl. No.: 936,329

[22] Filed: Sep. 24, 1997

[51] Int. Cl.[6] ..... B65D 5/00

[52] U.S. Cl. ..... 229/183; 229/117.16; 229/115; 229/142; 229/125.39; 229/125.19; 229/117; 229/918; 229/199

[58] Field of Search ..... 229/183, 199, 229/117.16, 117.24, 128, 155, 142, 125.37, 125.39, 117, 117.01, 117.05, 23 BT, 125.19

[56] References Cited

U.S. PATENT DOCUMENTS

| | | | |
|---|---|---|---|
| 564,593 | 7/1896 | Craw . | |
| 641,500 | 1/1900 | Davidson . | |
| 732,071 | 6/1903 | Hartrampf . | |
| 783,089 | 2/1905 | Wildmann | 229/117.04 |
| 1,339,334 | 5/1920 | Heiser . | |
| 1,375,489 | 4/1921 | Davis . | |
| 1,926,365 | 9/1933 | Bergstein | 93/49 |
| 2,018,171 | 10/1935 | Himes | 229/41 |
| 2,122,654 | 7/1938 | Nickerson | 229/199 X |
| 2,324,905 | 7/1943 | Chambliss | 229/199 X |
| 2,348,070 | 5/1944 | Inman | 229/16 |
| 2,348,378 | 5/1944 | Goodyear | 229/41 |
| 2,418,963 | 4/1947 | Anderson, Jr. | 229/183 X |
| 2,472,698 | 6/1949 | Edtmiller | 229/41 |
| 3,055,569 | 9/1962 | Layne, Sr. | 229/16 |
| 3,058,585 | 10/1962 | Budd | 229/155 X |
| 3,286,907 | 11/1966 | Crane | 229/41 |
| 3,301,461 | 1/1967 | Kroeschell | 229/16 |
| 3,366,496 | 1/1968 | Bomar et al. | 229/183 X |
| 3,477,633 | 11/1969 | Greene et al. | 229/117.24 X |
| 3,550,837 | 12/1970 | Erb | 229/125.37 |
| 3,667,666 | 6/1972 | Pryor | 229/16 B |
| 4,418,963 | 12/1983 | Anderson, Jr. | 229/37 |
| 5,295,632 | 3/1994 | Zink et al. | 229/199 X |
| 5,394,982 | 3/1995 | Sawaya | 229/125.37 X |

*Primary Examiner*—Gary E. Elkins
*Assistant Examiner*—Tri M. Mai
*Attorney, Agent, or Firm*—Lathrop & Clark

[57] ABSTRACT

A quick-assembly corrugated box has an automatic bottom panel which extends from a side panel, and has two converging reverse-scored fold lines which extend outwardly from the side panel. End flaps are folded up from the automatic bottom panel and are adhesively connected to the end panels to form double ply side walls. One of the end flaps has a diagonal fold line, with portions of the flap above the diagonal fold line only being adhered to the end panel. The angles of the reverse scored fold lines are selected to allow the automatic bottom panel to be deployed from a folded position alongside the side and end panels to an assembled position perpendicular to the side and end panels, simply by displacing one side panel with respect to the other. Substantially increased stacking strength is provided by inserting right-angle corner pieces in reinforcement-receiving pockets defined between the edges of the end flaps and the end panels. Tabs may be provided on the end flaps to permit engagement and retention of the corner pieces. The box may be conveniently sealed by hook-and-loop fastener material affixed to closure flaps which extend downwardly from two overlapping side top flaps.

27 Claims, 6 Drawing Sheets

HIGH STACKING STRENGTH AUTOMATIC CORRUGATED BOX

FIELD OF THE INVENTION

The present invention relates to corrugated paperboard containers in particular, and to corrugated boxed with automatic bottoms in particular.

BACKGROUND OF THE INVENTION

Corrugated paperboard boxes provide an exceptionally rugged, economical, and adaptable container for shipment and storage of goods. Because of the multi-ply construction of corrugated paperboard, the material is extremely lightweight for its stiffness. Nonetheless, the finishing or conversion of raw paper or corrugated board into a corrugated container commonly is accomplished at a location distant from the final use of the container. Hence, to economically transport the box, it must be shipped in an unassembled or knocked-down configuration. When products are to be placed in boxes in an industrial facility, the need to mechanically assemble the container with adhesives is readily addressed. Yet many boxes are used in the field, in homes, businesses, or agricultural settings, far from the jigs and wet adhesives of the factory floor. These boxes must be capable of being assembled without the need for post-manufacture adhesives.

Crash bottom, or automatic bottom boxes have been developed which are mechanically assembled without the aid of tools or adhesives. These boxes employ an arrangement of flaps and panels, which, by diligent manipulation by the end user, can be more or less rapidly assembled into a finished container. Nevertheless, conventional automatic boxes leave much to be desired in ease of assembly and final stacking strength. Boxes employed for document storage, for example, may contain significant loads when stacked. If a box cannot successfully carry the loads applied, the contents may be damaged, or the stack itself may collapse. Furthermore, occasional users of the boxes should not have to read detailed instructions, or follow an extended sequence of steps to assemble a box.

What is needed is a corrugated container which can be simply and rapidly assembled, and which has adequate levels of stacking strength.

SUMMARY OF THE INVENTION

The corrugated paperboard box of this invention has two side panels which are joined by parallel end panels. An automatic bottom panel extends from a side panel, and has two converging reverse-scored fold lines which extend between a side panel and the outer edge of the automatic bottom panel. End flaps are folded up from the automatic bottom panel and are adhesively connected to the end panels to form double ply side walls to the box. One of the end flaps has a diagonal fold line, with portions of the flap above the diagonal fold line only being adhered to the end panel. The angles of the reverse scored fold lines are selected depending on the dimensions of the box to allow the automatic bottom panel to be deployed from a folded position alongside the side and end panels to an assembled position perpendicular to the side and end panels, simply by displacing one side panel with respect to the other. The box is hence very simple to assemble and take down, yet has desirable stiffness and stacking strength due to the multi-ply assembly of the end walls.

Substantially increased stacking strength is provided by forming reinforcement-receiving pockets between the edges of the end flaps and the end panels. Corner pieces composed of fiber board, plastic or other material are inserted in the pockets to greatly increase the stacking strength of the box while only marginally increasing the material consumed. Flaps or tabs may be provided on the end flaps to permit engagement and retention of the corner pieces.

The box may be conveniently sealed by closure flaps which extend downwardly from two overlapping side top flaps. One half of a hook-and-loop fastener is adhered to each of the closure flaps, and the other half of the fastener is adhered to the exterior of the side panels. The connected hook-and-loop fastener materials serve to retain the side top flaps closed when the box is used for storage.

It is an object of the present invention to provide a corrugated box which may be rapidly assembled from a knocked-down condition.

It is another object of the present invention to provide a corrugated box of economical construction.

It is a further object of the present invention to provide a corrugated box with laminated sides which permits automatic assembly.

It is an additional object of the present invention to provide a corrugated box which may be readily reinforced for high load-carrying requirements.

It is yet another object of the present invention to provide a corrugated box which may be readily closed without strings or adhesives.

It is a still further object of the present invention to provide a corrugated box which is conveniently closed.

It is also an object of the present invention to provide a box with an automatic bottom of corrugated paperboard which can be assembled without distortion of the rigid panels.

It is yet another object of the present invention to provide a knocked-down corrugated paperboard container which can be assembled by applying pressure to the elongated ends of the knocked-down box.

It is still another object of the present invention to provide a corrugated container with an automatic bottom having four smooth, flat outside surfaces, and smooth flat, two-ply bottom surfaces.

It is also another object of the present invention to provide an automatic bottom box having several layers of corrugated board in the end walls to facilitate strong handholds for lifting the loaded box.

It is yet a further object of the present invention to provide a box having two thicknesses of material in the end walls to easily accept the addition of a plastic handle to assist in pulling a box from a shelf, and which will provide additional strength not found in present office storage type boxes.

Further objects, features and advantages of the invention will be apparent from the following detailed description when taken in conjunction with the accompanying drawings.

DESCRIPTION OF THE PREFERRED EMBODIMENTS

Figure 1:
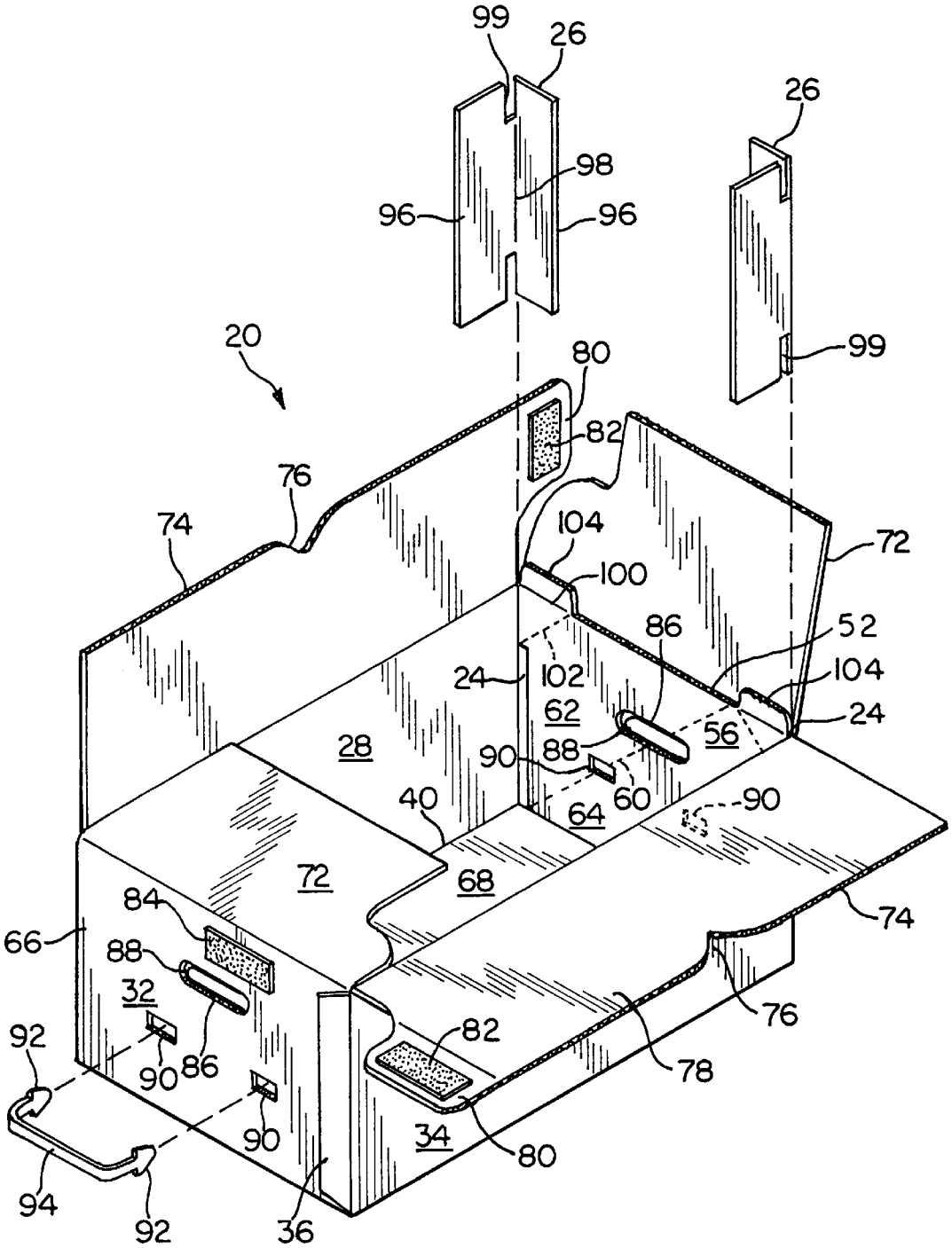
FIG. 1 is an isometric, partially exploded view of the automatic box of this invention.

Referring more particularly to FIGS. 1–8, wherein like numbers refer to similar parts, a corrugated paperboard box 20 of this invention with improved stacking strength is shown in FIG. 1. The box 20 is formed in a knocked-down condition at the factory from a single corrugated paperboard blank 22, shown in FIG. 2. The blank 22 is cut, folded, and adhesively connected such that the knocked-down article is readily expandable into a box with minimal effort by the end user and without the need for connectors or adhesives in the final box assembly. In addition, the blank 22 is fabricated to create multiple pockets 24 for receiving reinforcing corner pieces 26 which add substantial stacking strength to the box for applications in which one box will be stored on top of another.

Figure 2:
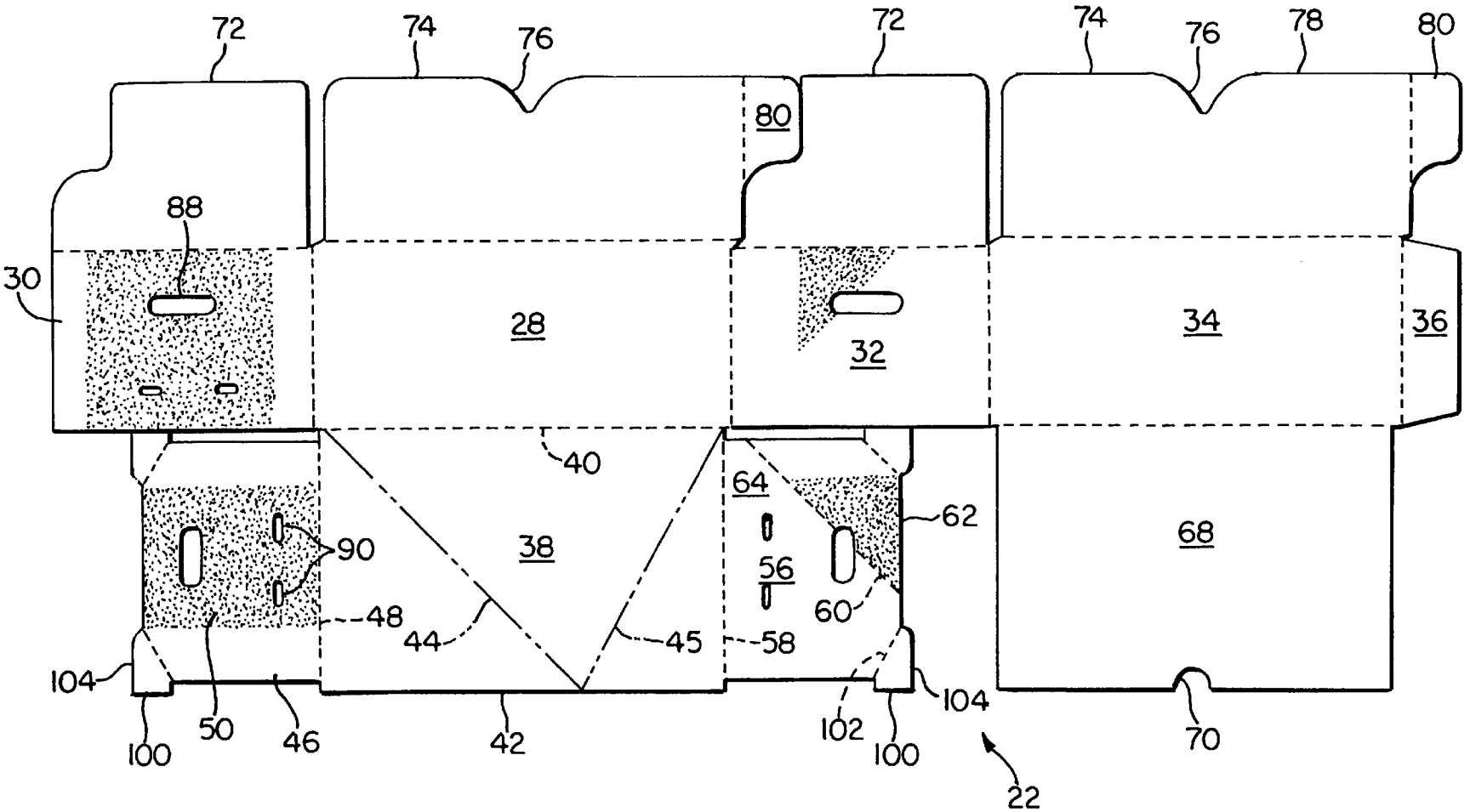
FIG. 2 is a schematic view of a corrugated blank for assembly into the box of this invention.

The blank 22, as shown in FIG. 2, is for the fully enclosable box 20. However, it should be noted that blanks may likewise be fabricated for boxes which are open or which lack top closure flaps. The blank 22 is a single thickness of conventional corrugated paperboard, having one, two, or more plies of corrugations, depending on the ultimate strength required. The blank 22 is die-cut and folded to minimize waste or un-utilized segments of corrugated paperboard. The box 20 is preferably generally rectangular, and therefore the blank 22 has a rectangular first side panel 28, with a first end panel 30 extending along a fold line on one side of the first side panel, and a second end panel 32 extending along a fold line on the other side. A second side panel 34, of dimensions similar to the first side panel 28, extends along a fold line from the second end panel 32. A glue flap 36 extends from the second side panel 34 along a fold line. The glue flap 36 is adhesively connected to the exterior of the first end panel 30. It should be noted that the glue flap may alternatively be connected to the interior of the first end panel 30. The side panels and the end panels form the vertically extending side walls of the assembled box 20.

Figure 5:
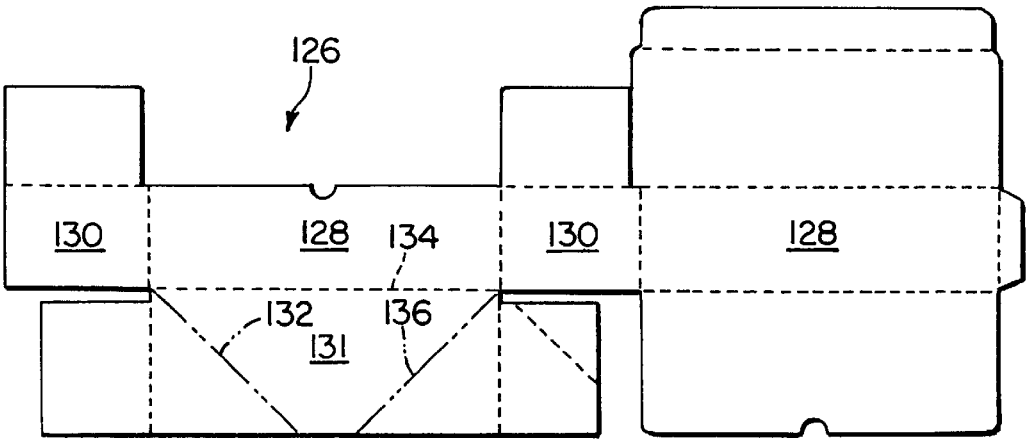
FIG. 5 is a simplified schematic view of a corrugated blank for assembly into the box of this invention wherein the width of the box sides is greater than twice the width of the box ends.
Figure 7:
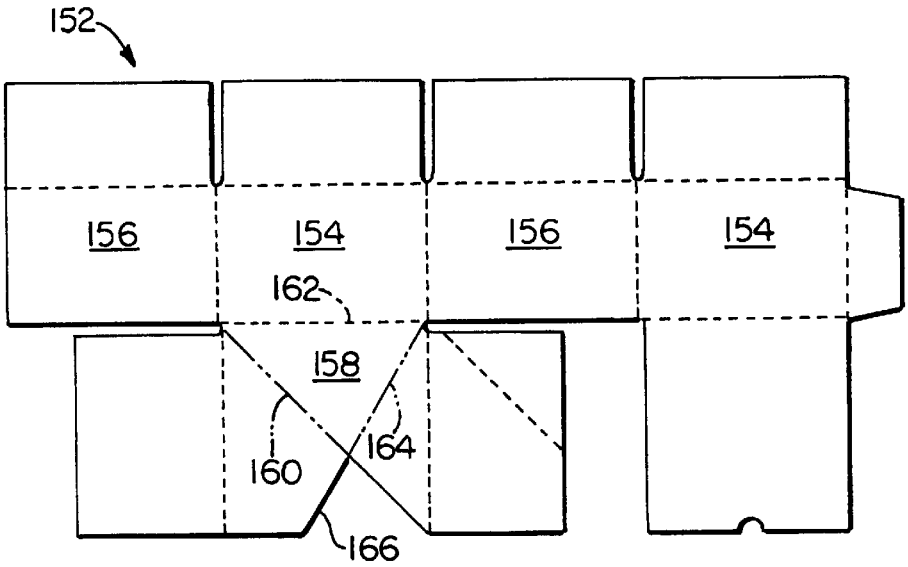
FIG. 7 is a simplified schematic view of a corrugated blank for assembly into the box of this invention wherein the width of the box sides is the same as the width of the box ends.

An automatic bottom panel 38 extends from the first side panel 28 along a bottom fold line 40. The automatic bottom panel 38 is generally rectangular with a width approximately equal to the horizontal width of the side panels, and a length approximately equal to the horizontal width of the side panels. The automatic bottom panel 38 has an outer edge 42 which is spaced parallel from the bottom fold line 40. A first reverse-scored diagonal fold line 44 extends from the bottom fold line 40 to the outer edge 42. The first reverse fold line 44 must extend at about 45 degrees from the bottom panel fold line 40. A second reverse-scored diagonal fold line 45 extends from the bottom panel fold line 40 the outer edge 42. The first fold line 44 converges toward the second fold line 45. When the box 20 has side panels which are less than twice the width of the end panels, the first fold line and the second fold line will meet along the outer edge 42. For boxes of different dimensions, the two fold lines may terminate at different positions along the outer edge, as shown in FIGS. 5 and 7 and discussed in greater detail below. Nevertheless, the angle of the first reverse fold line 44 will always be about 45 degrees.

A first generally rectangular end flap 46 extends from the automatic bottom panel 38 along a first end flap fold line 48. A first angle is defined between the first end flap fold line 48 and the first fold line 44. A rectangular attachment region 50, indicated in FIG. 2 by a stippling pattern, is defined on the exterior face of the first end flap 46. In manufacture of the box 20, adhesive is applied to the attachment region 50 and the first end flap 46 is glued to the first end panel 30 to form a multi-ply end wall 52, as shown in FIG. 1. The attachment region 50 for application of adhesive is preferably less than the entire width of first end flap 46, such that two pockets 24 are defined between the first end flap 46 and the first end panel 30. The pockets 24 open upwardly to receive reinforcing corner pieces 26, as discussed below. It should be noted, however, that in boxes which do not require reinforcing corners, the entire surfaces of the end flaps which do not move with respect to the end panels may be adhered together.

A second rectangular end flap 56 extends from the automatic bottom panel 38 along a second end flap fold line 58. A second angle of approximately 45 degrees is defined between the second end flap fold line 58 and the second fold line 45 on the automatic bottom panel 38. In order for the automatic bottom panel 38 to be free to collapse, the second end flap 56 cannot be fully connected to the second end panel 32. The second end flap 56 is therefore formed with a diagonal fold line 60 which extends at a 45 degree angle from the bottom edge of the flap along the second end flap from a point adjacent the intersection of the second reverse-scored fold line 45 and the bottom fold line 40. The diagonal fold line 60 thus divides the second end flap 56 into an upper portion 62 which is adhesively connected to the second end panel 32, and a lower portion 64 below the diagonal fold line which is not connected to the second end panel. Adhesive is applied to the exterior face of the upper portion 62 of the second end flap 56 and brought into contact with the second end panel to connect the second end flap to the second end panel and create a second multi-ply end wall 66. As on the first end wall 52, the adhesive is not applied all the way out to the exterior margins of the second end flap, to define two peripheral pockets 24 which open upwardly to receive reinforcing corner pieces. The end flaps 46, 56, extend the full depth of the box to better contribute to the stacking strength of the box.

Figure 8:
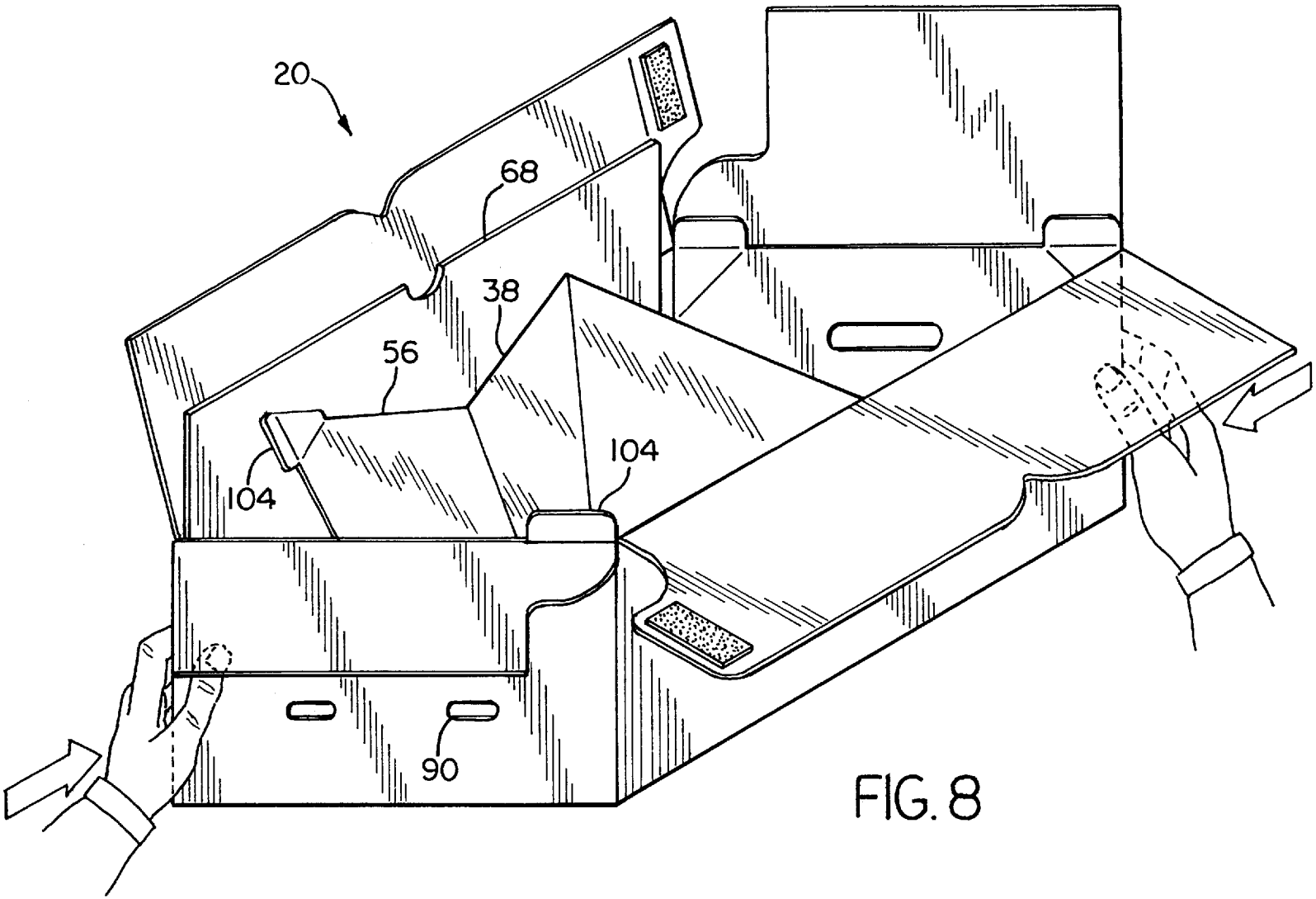
FIG. 8 is a pictorial view of the collapsed box of this invention being expanded into a storage container.

The automatic bottom panel, fixed to one end panel, and fixed along a diagonal fold line to the other panel, may thus be extended between a collapsed position alongside and substantially parallel to the side and end panels, and an assembled position substantially perpendicular to the side and end panels. As shown in FIG. 8, this transformation of the finished blank from a compact, flat, corrugated assembly, to a dimensional storage box is effected by displacing the first side panel with respect to the second side panel, by, for example, gripping the flat assembly at the corners and applying pressure towards the interior of the assembly. This manipulation causes the article to expand into a box.

An interior bottom panel 68 extends along a fold line from the second side panel 34. The interior bottom panel 68 has approximately the same dimensions at the automatic bottom panel 38, and, in the knocked-down position, lies adjacent and between the folded side panels 28, 34. After the box 20 has been expanded so that the automatic bottom panel 38 forms the horizontal bottom of the box, the interior bottom panel 68 is pivoted downwardly to overlie the automatic bottom panel and there defines a flat, uncreased bottom to the box. To facilitate collapsing of the box 20 subsequent to assembly, the interior bottom panel may be provided with a finger opening cut-out 70 along its perimeter to permit a user to reach beneath the interior bottom panel, and fold it back along the second side panel 34, thereby permitting the box to be collapsed by applying upward pressure on the automatic bottom panel 38.

Figure 4:
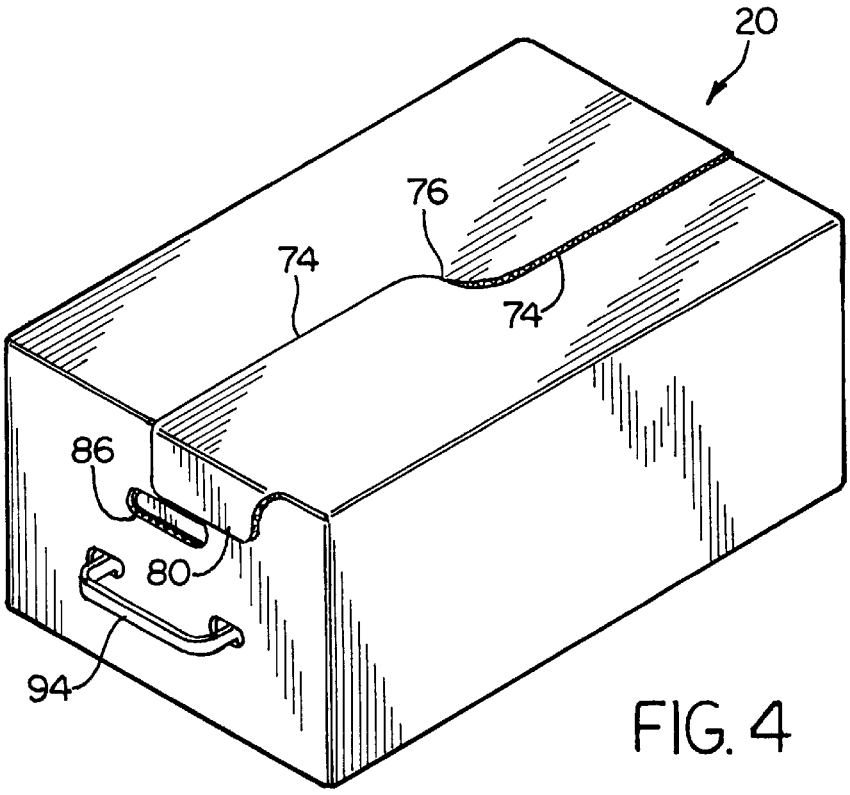
FIG. 4 is an isometric view of the closed assembled box of FIG. 1.

Although the box 20 may be an open, uncovered container, it may be provided with a convenient closure to seal the box and protect the contents. As shown in FIGS. 1 and 2, an end top flap 72 extends upwardly from each end panel 32, 34. A side top flap 74 extends upwardly from each side panel 28, 34. The side top flaps 74 are preferably provided with a generally triangular cut-away 76 centered along the outer perimeter 78 of the flap. As shown in FIG. 4, the width of the side top flaps 74 is greater than one half the width of the box 20. Thus, when the side top flaps 74 are folded down, the triangular cut-aways 76 engage so that portions of the side top flaps 74 overlap.

As shown in FIG. 2, each side top flap 74 has a sidewardly extending closure flap 80. The material for the closure flaps 74 is economically provided by cutting the end top flaps 72 with narrow rectangular cut-aways. As shown in FIG. 1, the side top flaps 74 are releasably retained in a closed position by two-part hook and loop fasteners such as VELCRO® fasteners. One part of the hook and loop fastener, for example a strip 82 of hook material, is adhesively attached to each closure flap 80, while a strip 84 of loop material is adhesively attached to the outside of each end panel 30, 32 on the box exterior, so that the closure flaps 80 may be folded downwardly over the end panels to close the side top panels over the box. Furthermore, because the closure flaps 80 extend sidewardly, rather than upwardly, they do not extend the height of folded article when it is in its collapsed configuration.

The box 20 is preferably provided with handholds 86 for convenient lifting and transporting of the box. A handhold 86 is defined in each end wall 52, 66, by aligned oblong cut-outs 88 in the end panels 30, 32 and the end flaps 46, 56. Because the handholds 86 are formed in double thicknesses of corrugated paperboard, the box is better able to support the loads imposed by lifting at the handholds.

In certain applications, loaded boxes 20 are stored on shelves or in some other manner where it is necessary to pull the box outward without having ready access to the sides and back of the box. For those uses, the first end panel 30 and first end flap 46 have two small rectangular die-cut holes 90 which are sized to receive the barbed ends 92 of a flexible plastic handle 94, as shown in FIG. 1. The barbed ends 92 are rotated 90 degrees to pass through the holes 90, and then naturally pivot to retain the handle affixed to the first end wall 52. It should be noted, that because the first end wall is comprised of two plies of material, and the two plies are adhesively connected, added resistance to pulling out of the handle is provided.

Where boxes 20 are stored stacked one upon another the resistance of the boxes to collapse, or stacking strength, is of key concern. In long term document storage, for example, each box can be fully loaded with paper and can have considerable weight. High density, low cost, storage requires floor-to-ceiling stacking of containers, with the load on the bottom box being in the multiple hundreds of pounds. Increased stacking strength is obtained in conventional boxes by forming the box from corrugated paperboard of greater thickness, heavier paper weight or multiple thicknesses of corrugated paperboard. All of these options can add considerable cost to the container, as additional material is added to the container throughout, even in those regions which do not contribute to the stacking strength, for example the top flaps and the bottom flaps. The provision of the pockets 24 in the automatic bottom box 20 of this invention, makes it possible to increase the stacking strength of the box with minimal additional material.

As shown in FIG. 1, the stacking strength of the box 20 is increased by stiffening the corners of the box with removable corner pieces 26. The corner pieces may be made from fiberboard, plastic, corrugated paperboard, or other stiffening material. Each corner piece has two vertical panels 96 which are joined at a vertical fold line 98 and which extend at approximately ninety degrees from one another. In applications where greater stacking strength is called for, the end user of the box 20 inserts a corner piece 26 within each pocket 24, by pressing one of the panels 96 into the pocket between the end panel and the end flap. Because the end flap is adhered to the end flap inwardly of the pockets 24, the two thicknesses of corrugated material are adjacent one another at the pockets. By pressing in the panel of the corner piece 26, the two thicknesses are forced apart, and the panel is held in a friction fit. The fold line 98 is formed in a corner piece 26 so that the two panels tend to open up, rather than close upon one another. Thus, although only one panel 96 of each corner piece 26 is directly held within a pocket, the other panel is retained against a box side panel. The corner pieces 26 extend from the automatic bottom panel to the side top flaps, and hence are effective in supporting overhead loads.

To facilitate hand insertion of the corner pieces, access flaps 100 may be formed in the end flaps 46, 56, as shown in FIG. 1. The access flaps 100 are positioned along each pocket 24, and extend from the end flaps along a diagonal fold line 102. The access flaps 100 are about as wide as one panel of the corner piece. To insert a corner pieces, a user pivots an access flap 100 downwardly about a fold line 102 to reveal the pocket 24. When pivoted downward, the access flap 100 serves as a camming surface which helps to direct the thin corner piece panel 96 into the pocket. As shown in FIG. 1, each access flap 100 may have an upwardly extending tab 104 which extends along a fold line above the level of the side flap for ready grasping by a user. The access flaps 100 preferably extend to the neighboring side panel. The corner pieces 26 are preferably formed with upper and lower slots 99 adjacent the vertical fold line 98. The access flaps 100 will extend into the vertical slots 99, and will lock the corner pieces in place against unintended removal. The corner pieces 26 are preferably symmetrical, so that a corner piece of a single design may be used at all four corners in the box 20.

Figure 3:
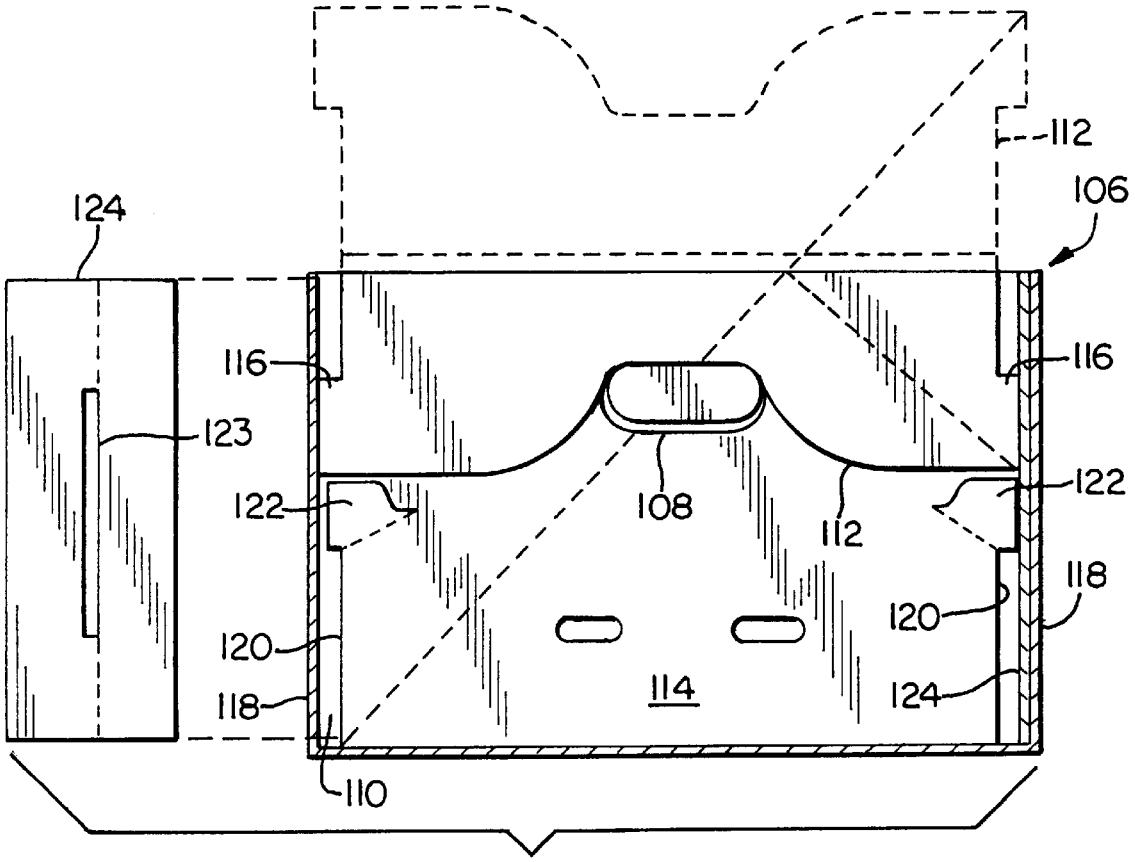
FIG. 3 is a cross-sectional view of an alternative embodiment box of this invention, having a hand-hold reinforcing flap and pivotable side flap tabs for access to reinforcing pieces.

An alternative embodiment box 106 of this invention is shown in FIG. 3. The box 106 is similar to the box 20 of FIG. 1, but has an additional ply of material over the handhold 108. The end panels 110 are formed with an upwardly extending reinforcement flap 112, which is folded downwardly over the adjacent end flap 114 above the handhold 108 after the box has been erected from the knocked-down configuration. The reinforcement flap 112 has sidewardly extending tabs 116 which engage within vertical slots 123 within the corner pieces 124. The access tabs 122 are positioned midway up along the end flap 114, and the access tabs 122 are also held in place within the vertical slots 123 in the corner pieces 124.

Figure 6:
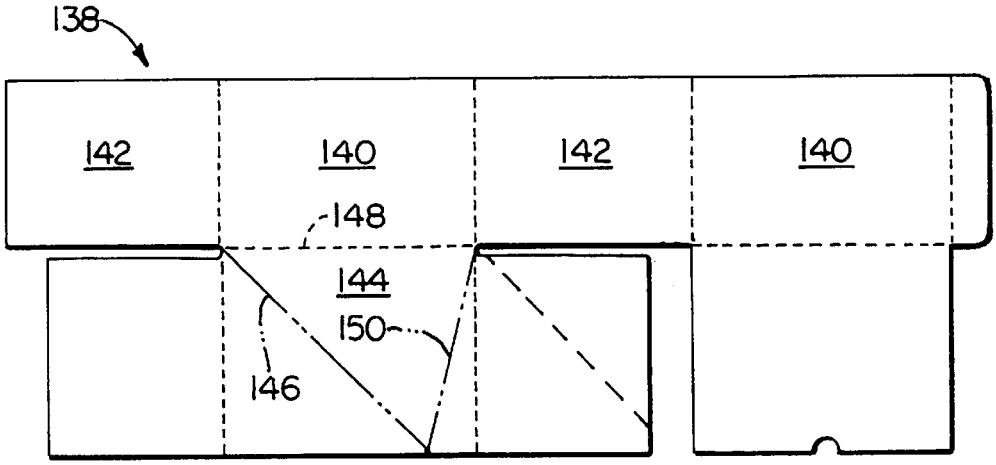
FIG. 6 is a simplified schematic view of a corrugated blank for assembly into the box of this invention wherein the width of the box sides is less than twice the width of the box ends.

Alternative blanks for the creation of the box of this invention are shown in FIGS. 5, 6, and 7. The alternative blanks illustrate, in simplified form, the three possible box length to width ratios, and the treatment of the automatic bottom panel to preserve the desirable assembly features of this invention.

The box 126 has side panels 128 which are more than twice the width of the end panels 130. The box 126 thus has an automatic bottom panel 131 first reverse score line 132 which extends at an angle of 45 degrees from the bottom fold line 134, and a second reverse score fold line 136 which is at least 45 degrees from a line perpendicular to the bottom fold line. It should be noted however, that the angle of the second reverse score fold line 136 may be at a greater angle, up to the angle at which the first reverse score fold line and the second reverse score fold line meet at the outer perimeter of the automatic bottom panel.

Another alternative embodiment box 138, shown in FIG. 6, is similar to the box 20, and has side panels 140 which are less than twice the width of the end panels 142. In such a box, the automatic bottom panel 144 again has a first reverse score fold line 146 which extends from the bottom fold line 148 at an angle of 45 degrees, while the second reverse score fold line 150 is positioned to extend from a point adjacent the corner of the automatic bottom panel along the bottom fold line 148 to a point along the outer perimeter of the automatic bottom panel meeting the first fold line 146.

Another alternative embodiment box 152, shown in FIG. 7, illustrates the third case, in which the side panels 154 are approximately the same width as the end panels 156. The box 152 has an automatic bottom panel 158 with a first reverse score fold line 160 which extends from the bottom fold line 162, and a second reverse score fold line 164 which also extends from the bottom fold line. The first and second fold lines 160, 164, extend from opposite corners of the automatic bottom panel 158 and cross as they extend to the outer perimeter of the automatic bottom panel. The triangular region between the outer perimeter and the crossed fold lines 160, 164 defines a cut-out 166 which is removed. The angle of the first fold line 160 with respect to the bottom fold line is, again, 45 degrees, while the angle of the second reverse fold line 164 with a line perpendicular to the bottom fold line is preferably about 60 degrees.

Figure 9:
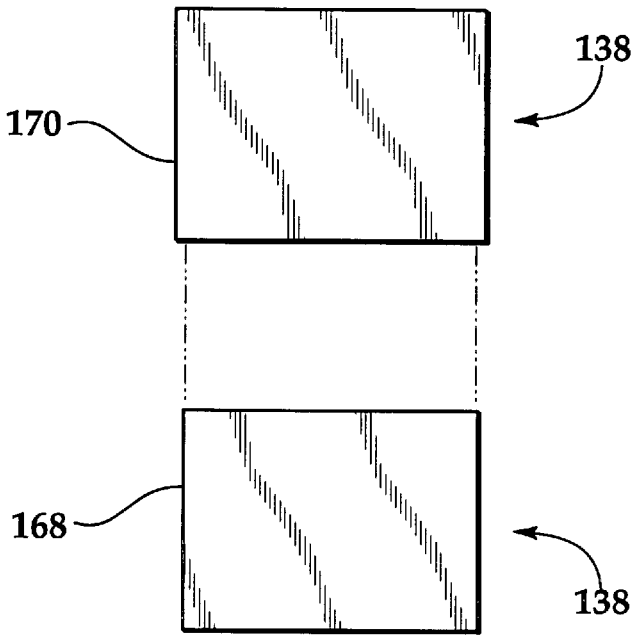
FIG. 9 is an exploded side elevational view of two assembled blanks of FIG. 6, positioned one above the other, such that one assembled blank serves as a cover for the other.

It should be noted that two boxes 138, without top flaps, may be fabricated with a first box 168 which has length and width dimensions approximately the corrugated paperboard width less than the length and width dimensions of a second box 170, as shown in FIG. 9. The two boxes 138 have the advantageous automatic bottom features of this invention, and hence may be compactly stored. In the field however, for example in fruit harvesting applications, the first box may be filled with produce, and the second box then assembled, inverted, and slid down over the first box to cover and close it. Such a box will have advantageous stacking strength, due to the presence of four plies of corrugated paperboard material at the end walls, and two plies at the side walls.

It should be noted that the fold lines which have been discussed above as reverse score lines, may also be perf rolled, or otherwise treated to permit folding of portions of the automatic bottom panel in the directions desired.

It is understood that the invention is not limited to the particular construction and arrangement of parts herein illustrated and described, but embraces such modified forms thereof as come within the scope of the following claims.

I claim:

1. A corrugated paperboard article for assembly into a box, the article comprising:

a first side panel;

a first end panel which extends sidewardly from the first side panel;

a second end panel which extends sidewardly from the first side panel spaced from the first end panel;

a second side panel extending between and connected to the first end panel and the second end panel;

an automatic bottom panel which extends from the first side panel along a bottom fold line, the automatic bottom panel having an outer edge which is substantially parallel to the bottom fold line and which is spaced from the bottom fold line, wherein a first fold line extends from the bottom fold line to the automatic bottom panel outer edge, and wherein a second fold line extends from the bottom panel fold line to the bottom panel outer edge, such that the first fold line and the second fold line converge toward one another and terminate at the bottom panel outer edge;

a first end flap which extends from the automatic bottom panel along a first end flap fold line, a first angle being defined between the first end flap fold line and the first fold line, wherein a portion of the first end flap is adhesively connected to the first end panel, to form a multi-ply end wall; and a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels.

2. The article of claim 1 wherein the first angle is 45 degrees.

3. The article of claim 2 wherein the width of the first side panel is more than twice the width of the first end panel, and wherein the second angle is at least 45 degrees.

4. The article of claim 2 wherein the first fold line on the automatic bottom panel crosses the second fold line on the automatic bottom panel, to define a cut-out which extends between the crossed first fold line and the second fold line and the outer edge of the automatic bottom panel.

5. The article of claim 1 wherein the diagonal fold line which divides the second end flap extends from the second end flap fold line at an angle of about 45 degrees.

6. The article of claim 1 further comprising a second article of claim 1 wherein the second article is larger than the article of claim 1 such that the second article may be expanded to serve as a cover for the article of claim 1 when expanded into a box.

7. The article of claim 1 further comprising:

a first top side flap which extends from the first side panel; and a second side top flap which extends from the second side panel, the first side top flap and the second side top flap being pivotable about the side panels from which they extend such that portions of the side top panels overlap one another to close the assembled box.

8. The article of claim 7 wherein both the first side top flap and the second side top flap have portions defining an approximately triangular cut-out, such that the triangular cut-outs of the two side top flaps engage when the assembled box is closed.

9. The article of claim 1 wherein portions of each end flap and each end panel have holes which are aligned in the assembled box, and wherein a flexible plastic handle has portions which extend into the aligned holes of one end flap and one end panel to retain the handle on the article.

10. A corrugated paperboard article for assembly into a box, the article comprising:

a first side panel;

a first end panel which extends sidewardly from the first side panel;

a second end panel which extends sidewardly from the first side panel spaced from the first end panel;

a second side panel extending between and connected to the first end panel and the second end panel;

an automatic bottom panel which extends from the first side panel along a bottom fold line, the automatic bottom panel having an outer edge which is spaced from the bottom fold line, wherein a first fold line extends from the bottom fold line to the automatic bottom panel outer edge, and wherein a second fold line extends from the bottom panel fold line to the bottom panel outer edge, such that the first line and the second fold line converge toward one another;

a first end flap which extends from the automatic bottom panel along a first end flap fold line, a first angle being defined between the first end flap fold line and the first fold line, wherein the first angle is 45 degrees, and wherein a portion of the first end flap is adhesively connected to the first end panel, to form a multi-ply end wall; and a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels, and wherein the first fold line on the automatic bottom panel crosses the second fold line on the automatic bottom panel, to define a cut-out which extends between the crossed first fold line and the second fold line and the outer edge of the automatic bottom panel, and wherein the second angle is 60 degrees.

11. A corrugated paperboard article for assembly into a box, the article comprising:

a first side panel;

a first end panel which extends sidewardly from the first side panel;

a second end panel which extends sidewardly from the first side panel spaced from the first end panel;

a second side panel extending between and connected to the first end panel and the second end panel;

an automatic bottom panel which extends from the first side panel along a bottom fold line, the automatic bottom panel having an outer edge which is spaced from the bottom fold line, wherein a first fold line extends from the bottom fold line to the automatic bottom panel outer edge, and wherein a second fold line extends from the bottom panel fold line to the bottom panel outer edge, such that the first line and the second fold line converge toward one another;

a first end flap which extends from the automatic bottom panel along a first end flap fold line, a first angle being defined between the first end flap fold line and the first fold line, wherein a portion of the first end flap is adhesively connected to the first end panel, to form a multi-ply end wall; and a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels, and wherein portions of the first end flap are not connected to the first end panel, to define a pocket which extends along the first end panel, and further comprising at least one corner piece having two generally perpendicular panels, one of the corner piece panels being received within the pocket to reinforce the paperboard article when assembled into a box.

12. A corrugated paperboard article for assembly into a box, the article comprising:

a first side panel;

a first end panel which extends sidewardly from the first side panel;

a second end panel which extends sidewardly from the first side panel spaced from the first end panel;

a second side panel extending between and connected to the first end panel and the second end panel;

an automatic bottom panel which extends from the first side panel along a bottom fold line, the automatic bottom panel having an outer edge which is spaced from the bottom fold line, wherein a first fold line extends from the bottom fold line to the automatic bottom panel outer edge, and wherein a second fold line extends from the bottom panel fold line to the bottom panel outer edge, such that the first line and the second fold line converge toward one another;

a first end flap which extends from the automatic bottom panel along a first end flap fold line, a first angle being defined between the first end flap fold line and the first fold line, wherein a portion of the first end flap is adhesively connected to the first end panel, to form a multi-ply end wall; and a second end flap which extends from the automatic bottom panel along a second end flap fold line, a second angle being defined between the second end flap fold line and the second fold line, wherein a diagonal fold line extends along the second end flap, dividing the second end flap into an upper portion which is adhesively connected to the second end panel, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels, and wherein each side top flap has a closure flap which extends therefrom, the closure flap being pivotable with respect to the side top flap from which it extends to overlie an adjacent end panel in the assembled closed box, and wherein the box is closed by a strip of hook material and loop material of a two-part hook and loop fastener positioned attached to each closure flap and the adjacent end panel.

13. A container comprising:

a corrugated paperboard blank having two opposed side panels, connected by two opposed end panels, and having end side flaps extending from a bottom flap, wherein portions of each of the end flaps are affixed to one of the blank end panels, to define an upwardly opening box;

portions of the end flaps which overlap the end panels and which extend sidewardly from the portions of the end flaps which are affixed to the end panels, the overlapping end flap portions being unaffixed to the end panels to define upwardly extending pockets;

reinforcing paperboard corner pieces having two upwardly extending panels, wherein each reinforcing corner piece is received within one of the pockets, the corner pieces extending the height of the end panels, to thereby reinforce the storage container and provide added stacking strength for the support of loads placed upon the storage container; and portions of each corner piece which define a vertically extending slot between the two panels of each corner piece, and wherein portions of at least one end flap extend sidewardly toward a side wall through the slot of one of the corner pieces received within the pocket, the one corner piece being thereby retained within the one pocket.

14. The container of claim 13 wherein the two end flaps comprise a first end flap and a second end flap, wherein the first end flap extends from an automatic bottom panel along a first end flap fold line, and the second end flap extends from the automatic bottom panel along a second end flap fold line, and wherein a portion of the first end flap is adhesively connected to one of the two end panels, to form a multi-ply end wall, and wherein a portion of the second end flap is adhesively connected to the other of the two end panels, and wherein a diagonal fold line extends along the second end flap, dividing the second end flap into an upper portion adhesively connected to said other end panel, and a lower portion below the diagonal fold line which is not connected to said other panel, and wherein parallel sideward displacement of the side panels causes the expansion of the container with the automatic bottom panel being alternatively positioned in a collapsed position alongside and substantially parallel to the side and end panels, and an assembled position substantially perpendicular to the side and end panels.

15. A container comprising:

a corrugated paperboard blank having two opposed side panels, connected by two opposed end panels, and having end side flaps extending from a bottom flap, wherein portions of each of the end flaps are affixed to one of the blank end panels, to define an upwardly opening box;

portions of the end flaps which overlap the end panels and which extend sidewardly form the portions of the end flaps which are affixed to the end panels, the overlapping end flap portions being unaffixed to the end panels to define upwardly extending pockets; and reinforcing paperboard corner pieces having two upwardly extending panels, wherein each reinforcing corner piece is received within one of the pockets, the corner pieces extending the height of the end panels, to thereby reinforce the storage container and provide added stacking strength for the support of loads placed upon the storage container, wherein each end flap has portions defining an access flap which is pivotable about a fold line to reveal one of the access pockets.

16. The container of claim 15 wherein a vertically extending slot is defined between the two panels of each corner piece, and wherein each access flap has portions which extend sidewardly toward a side wall through the slot of one of the corner pieces received within the pocket, the one corner piece being thereby retained within the one pocket.

17. The container of claim 16 wherein each end flap has a top, and wherein one of the access flaps is positioned along the top of one of the end flaps, and has a tab which protrudes therefrom for convenient grasping by a user.

18. The container of claim 16, wherein the end flap has a top positioned above a bottom, and wherein each access flap is positioned at a midpoint between the top and the bottom of the end flap.

19. The container of claim 18 wherein each end wall and end flap has portions defining a handhold opening therein, and further comprising a reinforcement flap which extends at a fold line from one of the end flaps above the handhold opening defined in the one end flap, the reinforcement flap having portions which extend sidewardly into the slot in one of the corner pieces, to be held thereby in a position adjacent the one end flap.

20. A container comprising:

a corrugated paperboard blank having two opposed side panels, connected by two opposed end panels, and having end side flaps extending from a bottom flap, wherein portions of each of the end flaps are affixed to one of the blank end panels, to define an upwardly opening box;

portions of the end flaps which overlap the end panels and which extend sidewardly from the portions of the end flaps which are affixed to the end panels, the overlapping end flap portions being unaffixed to the end panels to define upwardly extending pockets; and reinforcing paperboard corner pieces having two upwardly extending panels, wherein each reinforcing corner piece is received within one of the pockets, the corner pieces extending the height of the end panels, to thereby reinforce the storage container and provide added stacking strength for the support of loads placed upon the storage container, wherein each end wall and end flap has portions defining a handhold opening therein, and further comprising a reinforcement flap which extends at a fold line from one of the end flaps above the handhold opening defined in the one end flap, the reinforcement flap being folded to lie adjacent the one end flap above the handhold opening in the one end flap.

21. A container comprising:

a corrugated paperboard blank having two opposed side panels, connected by two opposed end panels, and having end side flaps extending from a bottom flap, wherein portions of each of the end flaps are affixed to one of the blank end panels, to define an upwardly opening box;

portions of the end flaps which overlap the end panels and which extend sidewardly from the portions of the end flaps which are affixed to the end panels, the overlapping end flap portions being unaffixed to the end panels to define upwardly extending pockets;

reinforcing paperboard corner pieces having two upwardly extending panels, wherein each reinforcing corner piece is received within one of the pockets, the corner pieces extending the height of the end panels, to thereby reinforce the storage container and provide added stacking strength for the support of loads placed upon the storage container, wherein the two side panels comprise a first side panel and a second side panel;

a first top side flap which extends from the first side panel; and a second side top flap which extends from the second side panel, the first side top flap and the second side top flap being pivotable about the side panels from which they extend such that portions of the side top panels overlap one another to close the assembled box.

22. The container of claim 21 wherein both the first side top flap and the second side top flap have portions defining an approximately triangular cut-out, such that the triangular cut-outs of the two side top flaps engage when the assembled box is closed.

23. The container of claim 22 wherein each side top flap has a closure flap which extends therefrom, the closure flap being pivotable with respect to the side top flap from which it extends to overlie the adjacent end panel in the assembled closed box, and wherein the box is closed by a strip of hook material and a strip of loop material of a two-part hook and loop fastener positioned attached to each closure flap and the adjacent end panel.

24. A container comprising:

a corrugated paperboard box having two opposed side panels, connected by opposed first and second end panels, with at least one panel defining a box bottom;

a first side top flap extending from one of the two side panels and a second side top flap extending from the other of the two side panels, the first side top flap and the second side top flap being pivotable about the side panels from which they extend such that portions of the first side top flap overlap portions of the second side top flap adjacent the first end panel and portions of the second side top flap overlap portions of the first side top flap adjacent the second end panel to close the box;

a closure flap extending from each of the side top flaps at a location where the side top flaps overlap an adjacent end panel, each closure flap being pivotable with respect to the side top flap from which it extends to overlie the adjacent end panel in the closed box; and a two-part hook and loop fastener positioned with a hook part on one of the closure flap and the side panel, and a loop part on the other of the closure flap and side panel, whereby the side top flaps may be releasably affixed in a closed position.

25. The container of claim 24 wherein the box bottom is defined by an automatic bottom panel which extends from a side panel, the automatic bottom panel having two end flaps extending therefrom, wherein portions of each end flap are adhesively connected to an adjacent end panel, and wherein the automatic bottom panel has two angled fold lines formed therein such that the box may be readily assembled from a collapsed positioned to an assembled position.

26. A container comprising:

a corrugated paperboard box having two opposed side panels, connected by opposed first and second end panels, with at least one panel defining a box bottom;

a first side top flap extending from one of the two side panels and a second side top flap extending from the other of the two side panels, the first side top flap and the second side top flap being pivotable about the side panels from which they extend such that portions of the first side top flap overlap portions of the second side top flap to close the box;

a closure flap extending from each of the side top flaps, each closure flap being pivotable with respect to the side top flap from which it extends to overlie the adjacent end panel in the closed box; and a two-part hook and loop fastener positioned with a hook part on one of the closure flap and the side panel, and a loop part on the other of the closure flap and side panel, whereby the side top flaps may be releasably affixed in a closed position, wherein each side top flap has portions defining an approximately triangular cut-out, such that the triangular cut-outs of the two side top flaps engage when the assembled box is closed.

27. A corrugated paperboard article for assembly into a box, the article comprising:

a first side panel;

a first end panel which extends sidewardly from the first side panel;

a second end panel which extends sidewardly from the first side panel spaced from the first end panel, wherein each end panel extends to an upper margin;

a second side panel extending between and adhesively connected to the first end panel and the second end panel;

an automatic bottom panel which extends from the first side panel along a bottom fold line, the automatic bottom panel having an outer edge which is spaced from the bottom fold line, wherein a first fold line extends from the bottom fold line to the automatic bottom panel outer edge, and wherein a second fold line extends from the bottom panel fold line to the bottom panel outer edge, such that the first fold line and the second fold line converge toward one another;

a first end flap which extends from the automatic bottom panel along a first end flap fold line, a first angle being defined between the first end flap fold line and the first fold line, wherein a portion of the first end flap is adhesively connected to the first end panel, to form a multi-ply end wall, and wherein the first end flap when connected to the first end panel extends to the upper margin, and wherein portions of the connected first end flap and first end panel define a hand hole opening; and a second end flap which extends from the automatic bottom panel along a second end flap fold line, a second angle being defined between the second end flap fold line and the second fold line, wherein a diagonal fold line extends along the second end flap, dividing the second end flap into an upper portion which extends to the upper margin and which is adhesively connected to the second end panel, portions of the connected second end flap and second end panel defining a hand hold opening, and a lower portion below the diagonal fold line which is not connected to the second end panel, wherein parallel sideward displacement of the first side panel with respect to the second side panel causes the article to expand into a box, with the automatic bottom panel being alternatively positioned in a collapsed position alongside and substantially parallel to the side and end panels, and an assembled position substantially perpendicular to the side and end panels.

* * * * *